United States Patent [19]

Guangorena

[11] 3,968,953

[45] July 13, 1976

[54] SELF-TAILING WINCH

[75] Inventor: Jesus Guangorena, Atherton, Calif.

[73] Assignee: Barient Company, San Carlos, Calif.

[22] Filed: Jan. 27, 1975

[21] Appl. No.: 544,125

[52] U.S. Cl. ..... 254/150 R; 254/175.7

[51] Int. Cl.[2] ..... B66D 1/30

[58] Field of Search ..... 254/150 R, 190 R, 175.7, 254/138, 183; 242/117, 96, 47.01; 114/218; 226/176, 185, 187, 193

[56] References Cited

UNITED STATES PATENTS

| | | | |
|---|---|---|---|
| 1,893,723 | 1/1933 | Wood | 254/150 R |
| 2,793,740 | 5/1957 | Daudt | 254/150 R |
| 3,120,043 | 2/1964 | Henley | 254/150 R |
| 3,193,254 | 7/1965 | Minnick | 254/150 R |
| 3,730,483 | 5/1973 | Newell | 254/150 R |

FOREIGN PATENTS OR APPLICATIONS

| | | | |
|---|---|---|---|
| 1,374,308 | 9/1960 | France | 254/150 R |

*Primary Examiner*—Frank E. Werner
*Assistant Examiner*—Kenneth Noland
*Attorney, Agent, or Firm*—Owen, Wickersham & Erickson

[57] ABSTRACT

A self tailing winch with which a rope can be automatically and properly pulled and paid out. A facing pair of clamping rings splined to a rotary winch drum for rotation therewith and define a generally angular shaped groove between them, one of the clamping rings having a smooth face and a cylindrical extension defining the winding diameter for the rope and the other ring having a serrated face, the two being yieldably urged together by an elastic member, a spring or springs. The rotary drum may be driven by a gear train from a rotated input shaft. A stationary annular plate anchored to a stationary frame lies adjacent to one clamp ring and supports a feeding device for feeding the rope from the drum to the groove and also supports a guide device for paying out rope from the groove.

6 Claims, 6 Drawing Figures

FIG. 4.
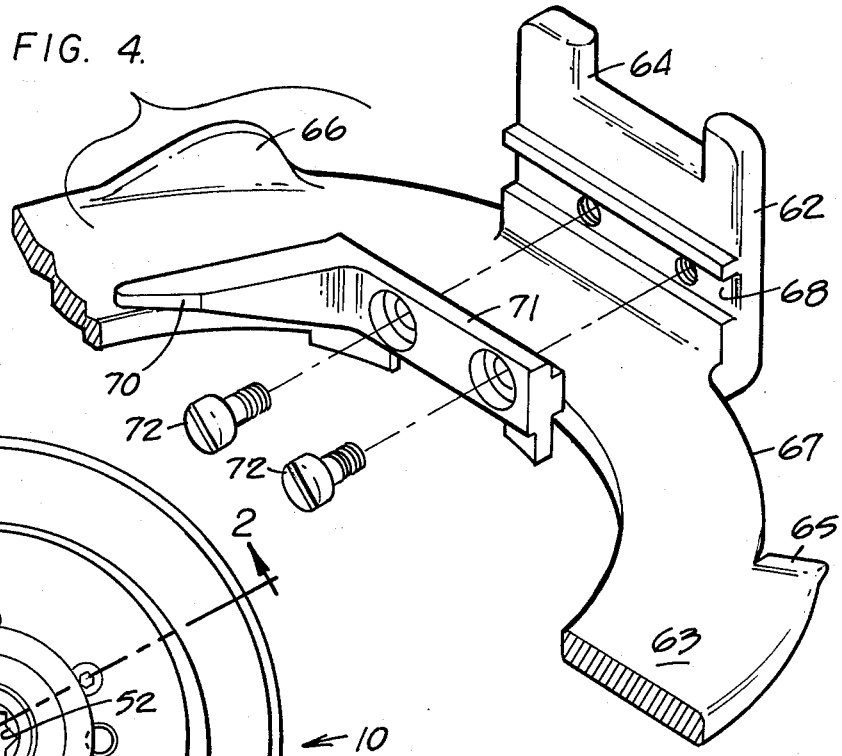
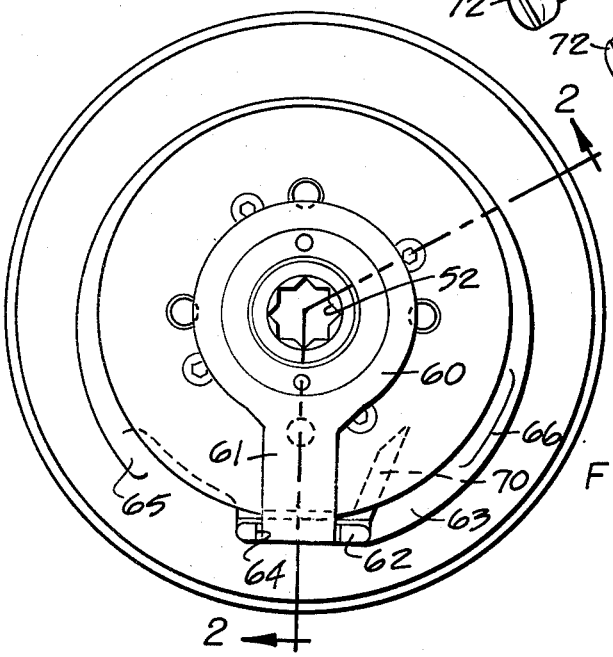
FIG. 3.
FIG. 5.
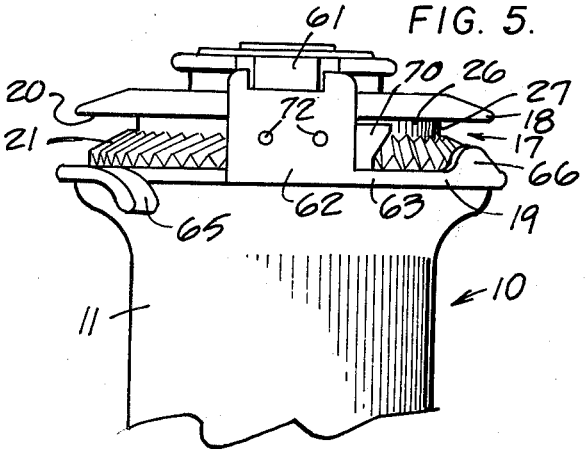
FIG. 6.
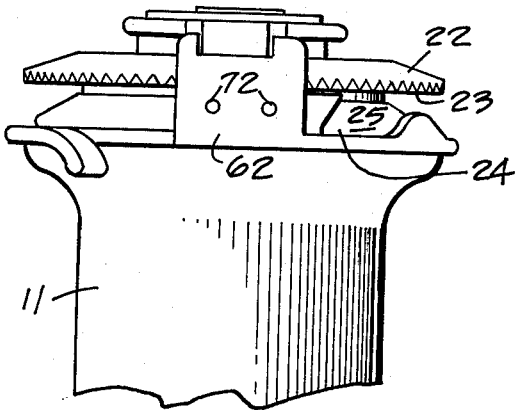

SELF-TAILING WINCH

BACKGROUND OF THE INVENTION

This invention relates to a self-tailing winch.

In most winches the rope must be paid out by hand or at least with hand assistance. This has obvious disadvantages which the present invention overcomes.

Heretofore, self-tailing winches have involved expensive V-groove pulley wheels having indentations made in them corresponding to the indentations in the rope, but in the present invention this is not necessary and, in fact, is considered to be undesirable as an unnecessary expense which does not increase the effectiveness of the device of the present invention. Also, the self-tailing winches heretofore in use have presented difficulties due to different tensions and different speeds at the point where the rope was fed from the drum to the pulley wheel. Sometimes these differential tensions tend to break the rope. Differential speeds between two such portions inevitably result in differential forces which cause trouble even when they do not result in actual breakage of the rope. It is important that the line speed of the rope unit entering the wheel be identical to the line speed at which it leaves the winch drum. However, they cannot be the same unless the bottom diameter of the groove into which they enter is the same as the diameter of the drum which they leave.

Further, limitations in use are present when a winch can be used with only one particular type of rope, or one diameter of rope. In the present invention it is possible to vary the rope diameter and the type of rope widely and still obtain satisfactory results, all without causing the differential speeds referred to above, whereas this was not the case with prior art winches which were intended to be self-tailing.

Thus, among the objects of the invention are to provide a self-tailing winch which is both simpler in its general configuration and also more adaptable.

Another object of the invention is to provide a self-tailing winch having provision for taking a wide variety of rope sizes and types, while still assuring proper payout.

Another object of the invention is to provide a self-tailing winch with identical line speeds when entering the wheel and leaving the drum from which the rope is paid out, and to provide this even though the rope size may be varied.

SUMMARY OF THE INVENTION

The present invention provides a self-tailing winch in which a stationary frame supports a rotatable input shaft and a rotary drum, the drum being driven by the input shaft through a gear train. The drum carries a facing pair of separate clamp rings which rotate with the drum and define between them a generally angular shaped groove. The groove face is smooth on one of the two clamp rings and is serrated on the other. The two clamp rings are urged toward each other by spring means which are yieldable enough to enable various sizes of ropes to be accommodated by the clamp rings moving apart when larger sizes are used and toward each other when smaller sizes are used. Moreover, an annular plate which is anchored to the frame lies adjacent to at least one of the clamp rings and supports a pair of stationary devices, one which assists in feeding the rope from the drum to the groove and the other which assists in paying out the rope from the groove.

As a result of this procedure, the spring mounting achieves the object of providing that the line speed at which the rope enters the groove between the two clamp rings is the same as the line speed at which it leaves the drum. The line is always urged to the bottom of the groove which is defined by a portion of the top ring. Adjustability in rope size is provided by the spring-mounted clamp rings, and adequate grip of the rope is provided by the combination of the serrations on one clamp ring and the smooth face on the other. Simplicity is achieved in the paying in and the paying out of the rope without having to provide an extra roller for that purpose, as has been the case in some of the previous self-tailing winches.

BRIEF DESCRIPTION OF THE DRAWINGS

In the drawings:

FIG. 3 is a top view;

FIG. 4 is a fragmentary view in perspective, partially exploded, of the stationary annular member which provides guide means for feeding the rope into the groove between the two clamp rings and for paying out the rope from that groove;

FIG. 5 is a fragmentary view in side elevation of the upper portion of the winch of FIG. 1;

FIG. 6 is a view similar to FIG. 5 of a modified form of the invention in which the upper clamp ring, instead of the lower clamp ring, has the serrated face, the smooth face being on the lower clamp ring instead of the upper clamp ring (as in FIG. 5).

DESCRIPTION OF A PREFERRED EMBODIMENT

Figure 1:
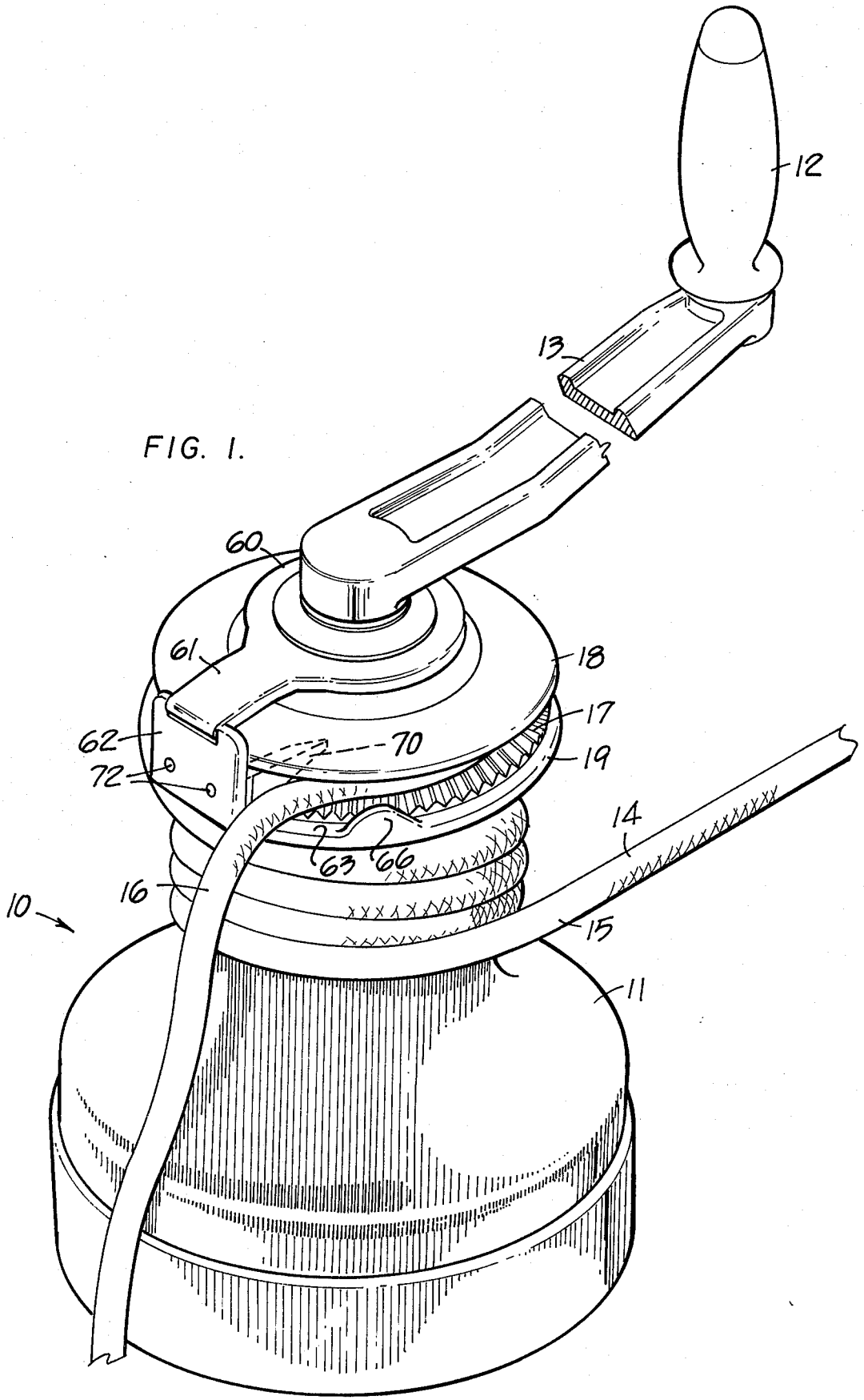
FIG. 1 is a view in perspective of a self-tailing winch embodying the principles of the invention.
Figure 2:
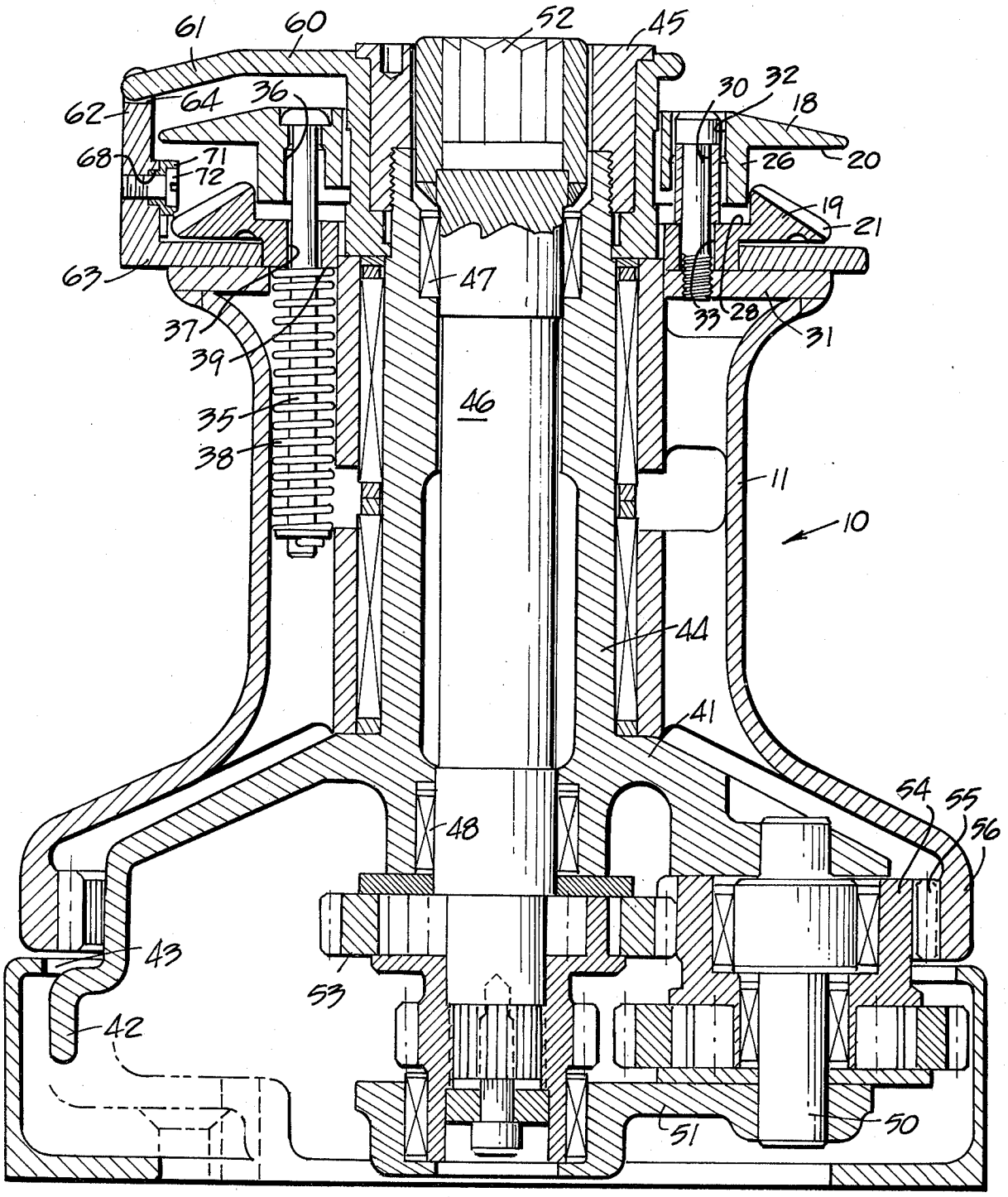
FIG. 2 is a view in elevation and in section of the winch of FIG. 1, taken along the line 2—2 in FIG. 3.

A self-tailing winch 10 is shown in perspective in FIG. 1 and in section in FIG. 2. It will be seen that the self-tailing winch 10 includes a drum 11 which is rotated when an operator moves a handle 12 to revolve a lever 13. This operation can wind up and pay out a rope 14, shown in FIG. 1 as having a portion 14 going onto (or out from) the drum 11 and a portion 16 coming out from (or going into) a generally angular shaped groove 17 that is provided between an upper clamp ring 18 and a lower clamp ring 19. As shown in FIGS. 2 and 5, the upper clamp ring 18 has a smooth inner face 20, facing the groove 17, while the lower clamp ring 19 has a serrated face 21 facing the groove 17. As shown in FIG. 6, this structure may be reversed, and there may be an upper clamp ring 22 having a serrated face 23 and a lower clamp ring 24 having a smooth face 25. The operation is not affected by this interchange.

Considering th specific example of FIGS. 1 – 5 in somewhat more detail, it will be seen that the upper clamp ring 18 may have its smooth face 20 lie in a horizontal plane and lead into an annular cylindrical portion 26 having a cylindrical surface 27 marking the inner limit of the groove 17. The serrated face 21 may lie at an angle so that the groove 17 is generally angular shaped, with its inner portion narrower than its outer portion. The lower clamp ring 19 has a cylindrically inset portion 26 enabling relative movement between the two clamp rings 18 and 19 toward and away from each other, and determining the take-up diameter of the wheel.

In this particular example, the two rings 18 and 19 are shown splined by a series of studs 30 to the top of the drum 11 with each stud 30 being clamped to the drum by screws 32 and extending through respective openings 34 and 33 in the clamp rings 18 and 19. (See FIGS. 2 and 3). There is also a series of spring guide members 35 extending through other openings 36 and 37 in the two rings 18 and 19 and each having a spring 38 secured to the lower end of the respective spring guide 35 and bearing against the lower clamp ring 19 at the surface 39. Thus, the springs 38 are always exerting a force tending to cause the faces 20 and 21 to move towards each other, whereas the pressure of a rope 14 in between the two faces 20 and 21 tends to force the two rings 18 and 19 apart and thereby achieve automatic adjustment. The springs 38 are readily made of the correct tension for accomplishing this, depending on the size of the winch 10 and the general uses to which it is to be put, all of which a man skilled in the art will have no trouble accomplishing.

The winch 10 may have a stationary base 40 constituting part of a stationary frame which also includes a gear housing member 41 locked by one or more fingers to the base 40 and having a generally cylindrical shank 44 extending up to and threaded to a drum nut 45 near the upper end of the winch shank 44. The shank 44 surrounds a main rotary shaft 46 and provides anti-friction bearings 47 and 48 for the shaft 46. One or more auxiliary shaft 50 is supported by the lower portion of the gear housing member 51.

A suitable driving connection for the main shaft 46 may be provided at its upper end by a broached key portion 52 for enabling a keyed end of the lever 13 to drive the shaft 46 and rotate it. The shaft 46 drives the drum 11 through a gear train at the lower end of the winch 10, most of which is shown in FIG. 2. The gear train of conventional design, having an upper gear 53 on the shaft 46 meshed with an upper gear 54 on the shaft 50, the gear 54 meshing with internal teeth 55 on an annular portion 56 of the drum 11.

Thus, when an operator rotates the handle 12, he revolves the lever arm 13, and this rotary action rotates both the drum 11 and the clamp rings 18 and 19. Of course, a power drive may be used instead of a manual drive, when desired.

The stationary gear housing 41 and drum nut 45 act to hold in place an anchor ring 60, which, in turn, has an offset radially extending arm 61 that engages an upwardly extending stripper plate 62. The generally rectangular stripper plate 62 is secured to a stationary annular plate 63, and may be an integral portion of it, having a notch 64 at its upper end to engage the arm 61. The annular plate 63 lies closely adjacent to the lower clamp ring 19 and has a specially shaped configuration to provide a line lifter 65 and a line retainer 66. The line lifter 65 is an angularly depressed portion of the plate 63 which extends downwardly at a peripheral gap 67 and enables the rope 14 to pass up from the winch drum 11 into the groove 17; it preferably lies a short distance away from the rectangular portion of the stripper plate 62, by a sufficient distance so that no size of rope with which the winch 10 is used need have any difficulty passing between the line lifter 65 and the stripper plate 62. The stripper plate 62 has (See FIG. 4) a rectangular slot 68. On the other side of the stripper plate 62 is the line retainer 66, preferably a raised projection which cooperates with a finger 70 that is secured to and projects radially inwardly from the stripper plate 62, to which it is secured. The finger 70 has a support portion 71 that extends generally perpendicular to the arm 70 and fits in the slot 68, being secured to the stripper plate 62 by machine screws 72. This stripper finger 70 cooperates with the projection 66 to cause the rope portion 16 to pay out from the groove 17 during the payout operation, or to guide it back into the groove 17 during the reverse operation, in which the rope 14 will be sent from the groove 17 to the drum 11. It will be noted that exactly the same operation is obtained in the structure of FIG. 6.

Thus, in operation of the device, the operator holds the handle 12 and revolves the lever arm 13, which rotates the main shaft 46 and through the gear train 53, 54, 55 rotates the drum 11. A rope 14 which is given a few turns around the drum 11 can thereby be fed in the gap 67 and over the lifter portion 65 into the groove 17, where the rope 14 is engaged by the two clamp rings 18 and 19 and is fed around the groove 17 and then paid out between the stripper arm 70 and the line retainer projection 66. Depending on the size of the rope 14, the springs 38 and the rope cooperate to seek the proper groove width at the bottom of the groove 17, and, since there are a plurality of springs 38 operating in equal ways, the pressure is always kept uniform at all points of the two rings 18 and 19, so that the rope speeds into the groove and out of the drum are always the same, thereby minimizing forces tending to break the rope. Similarly, the stripper arm 70 and the line retainer 66 operate to pay out the rope at the proper place at the same speed at which it enters the groove 18 from the drum 11, via the lifter 65.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

I claim:

1. A self-tailing winch for a rope, including in combination:

a stationary frame, a rotary input shaft rotatably supported by said frame, a rotary drum rotatably supported by said frame, a gear train connecting said rotary input shaft to said rotary drum so that said drum is driven by said shaft, a facing pair of clamp rings splined to said drum for rotation therewith and defining a generally V-shaped groove between them, one of said clamp rings having a smooth face defining one edge of said groove, the other said clamp ring having a serrated face, for better gripping of a rope between them, spring means for urging said clamp rings toward each other yieldably, and a stationary annular plate adjacent to one said clamp ring and anchored to said frame, said annular plate having a peripheral gap with an inclined rope lift means leading into the groove and serving as a rope feeding device, and said annular plate also including a peripheral projection extending along a portion of the periphery of said groove and a stripper finger secured by bracket means to said plate to lie generally parallel to said projection and extending toward the inner periphery of said plate.

2. A self-tailing winch for a rope, including in combination:

a stationary frame, a rotary input shaft rotatably supported by said frame, a rotary drum rotatably supported by said frame, a gear train connecting said rotary input shaft to said rotary drum so that said drum is driven by said shaft, a facing pair of ring-shaped clamping means operably connected to said drum for rotation therewith and defining a groove between them, at least one of said clamping means having a serrated face for better gripping of a rope in the groove and at least one clamping means being axially movable with respect to the other, spring means for urging said clamping means toward each other yieldably, a generally cylindrical member mounted for rotation with said drum adjacent to and interior of the groove defined by said pair of clamping means, providing an inner boundary of said groove to define a constant winding diameter for the rope, said cylindrical member being of diameter substantially equal to the winding diameter of the drum, a stationary member adjacent to the groove and anchored to said frame, rope guide means supported by said stationary member for assisting in feeding said rope between said drum and said groove, and rope stripping means supported by said stationary member for assisting in paying out said rope from said groove and for guiding it out therefrom.

3. The self-tailing winch of claim 2 wherein said stationary member is an annular plate adjacent to one of said clamping means, said annular plate having a peripheral gap with an inclined portion leading into the groove and serving as said feeding device.

4. The self-tailing winch of claim 2 wherein one of said clamping means includes an angular surface to help guide the rope into the groove.

5. The self-tailing winch of claim 2 wherein said pair of ring-shaped clamping means comprise a pair of clamp rings mounted adjacent to the drum, one ring being fixed with respect to the drum and the other being axially movable with respect thereto.

6. The self-tailing winch of claim 5 wherein said cylindrical member is affixed to and axially movable with said other clamp ring.

* * * * *